US006558179B2

(12) United States Patent
Nakamura et al.

(10) Patent No.: US 6,558,179 B2
(45) Date of Patent: May 6, 2003

(54) WATERPROOF CONNECTOR

(75) Inventors: Mitsuharu Nakamura, Shizuoka-ken (JP); Teruo Yokota, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/078,415

(22) Filed: Feb. 21, 2002

(65) Prior Publication Data

US 2002/0119690 A1 Aug. 29, 2002

(30) Foreign Application Priority Data

Feb. 23, 2001 (JP) ..... 2001-048105

(51) Int. Cl.[7] ..... H01R 13/52
(52) U.S. Cl. ..... 439/275; 439/752; 439/587
(58) Field of Search ..... 439/587, 588, 439/589, 271, 274, 275, 279, 347, 752, 595

(56) References Cited

U.S. PATENT DOCUMENTS 5,551,892 A * 9/1996 Endo et al. ..... 439/587
5,713,761 A * 2/1998 Okayasu ..... 439/271
6,325,661 B1 * 12/2001 Tabata ..... 439/587

FOREIGN PATENT DOCUMENTS

| | | |
|---|---|---|
| JP | 6-60072 | 8/1994 |
| JP | 10-050381 | 2/1998 |

* cited by examiner

*Primary Examiner*—Tho D. Ta
(74) *Attorney, Agent, or Firm*—Finnegan, Henderson, Farabow, Garrett, & Dunner. L.L.P.

(57) ABSTRACT

A waterproof connector is constituted by a connector housing provided with a mating hollow to which an opposing connector is fitted and a terminal housing protruded within the mating hollow, a first packing pressure contacted with the opposing connector within the mating hollow so as to be closely attached to a periphery of the terminal housing, and a slide arranged between the terminal housing and the first packing. The connector housing receives a plurality of cables provided with terminals at front ends so as to hold a second packing therebetween. The slide is provided with a plurality of slits being parallel to a sliding direction and respectively inserting the terminals, and a retaining portion extending toward the first packing in one end portion. The slits prevent the terminals from falling off in a side of the retaining portion, and allow the terminals to pass through in an opposite side.

2 Claims, 3 Drawing Sheets

WATERPROOF CONNECTOR

BACKGROUND OF THE INVENTION

1. Field of the Invention

The present invention relates to a waterproof connector which can securely execute a come-off prevention of a terminal and a waterproofing by a simple structure.

2. Description of the Related Art

A conventional waterproof connector is provided with a terminal housing in an inner portion of a connector housing and packing for waterproofing is fitted to a periphery of terminal housings. The connector housing is further provided with a terminal lance for preventing the terminal from falling off. The packing is pressed rearward so as to be held by inserting a front retainer from a forward portion of the terminal housing, and the terminal lance is pushed up so as to be engaged with the terminal, whereby a come-off prevention is executed. By fitting to an opposing connector in this state, the packing is closely attached between the terminal housing and the opposing connector, thereby achieving a waterproofing effect.

SUMMARY OF THE INVENTION

Since a compact terminal of the waterproof connector mentioned above has a complex structure, it is hard to make it compact. The present invention is made for the purpose of solving the problem mentioned above, and an object of the present invention provide connector which can easily be applied to the compact terminal by preventing the terminal from falling off on the basis of a simple structure and holding a packing.

The waterproof connector according to the present invention is constituted by a connector housing provided with a mating hollow to which an opposing connector is fitted and a terminal housing protruded within the mating hollow, a first packing pressure contacted with the opposing connector within the mating hollow so as to be closely attached to a periphery of the terminal housing, and a slide arranged between the terminal housing and the first packing. The connector housing receives a plurality of cables provided with terminals at front ends so as to hold a second packing therebetween. The slide is provided with a plurality of slits being parallel to a sliding direction and respectively inserting the terminals, and a retaining portion extending toward the first packing in one end portion. The slits prevent the terminals from falling off in a side of the retaining portion, and allow the terminals to pass through in an opposite side.

At a time of assembling the waterproof connector according to the present invention, the slide is positioned so that the slits allow the terminals to pass through. When positioning the slide on the opposite side, the terminal is prevented from falling off and the retaining portion is brought into contact with the first packing, whereby the packing is held. That is, since it is possible to prevent the terminals from falling off and hold the packing only by switching the slide, the structure becomes significantly simple. Further, since the slide is arranged between the terminal housing and the packing and positioned in an inner side of the mating hollow of the connector housing, it is possible to protect the slide by the connector housing at a time of transporting the waterproof connector or the like, it is possible to prevent an external force from being applied thereto, and it is possible to maintain the sliding state.

BRIEF DESCRIPTION OF THE DRAWINGS

FIG. 3 is a cross sectional perspective view of the waterproof connector according to an embodiment of the present invention, in which the slide is in a state of allowing the terminal to pass through.

DETAILED DESCRIPTION OF THE PREFERRED EMBODIMENT

Figure 1:
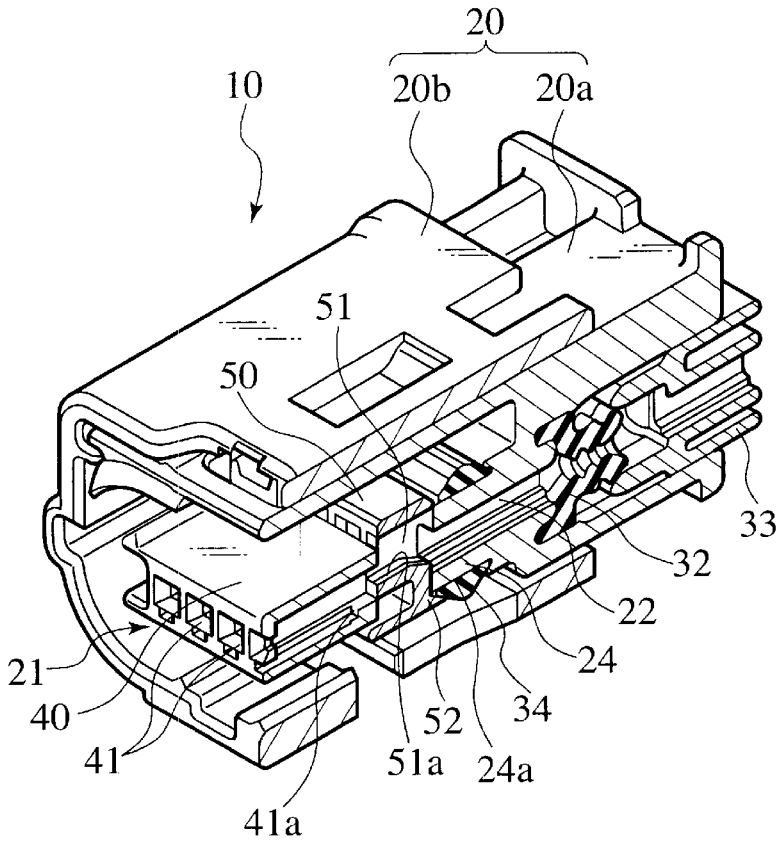
FIG. 1 is a cross sectional perspective view of a main portion of a waterproof connector according to an embodiment of the present invention, in which a slide is in a state of preventing a terminal from falling off.
Figure 2:
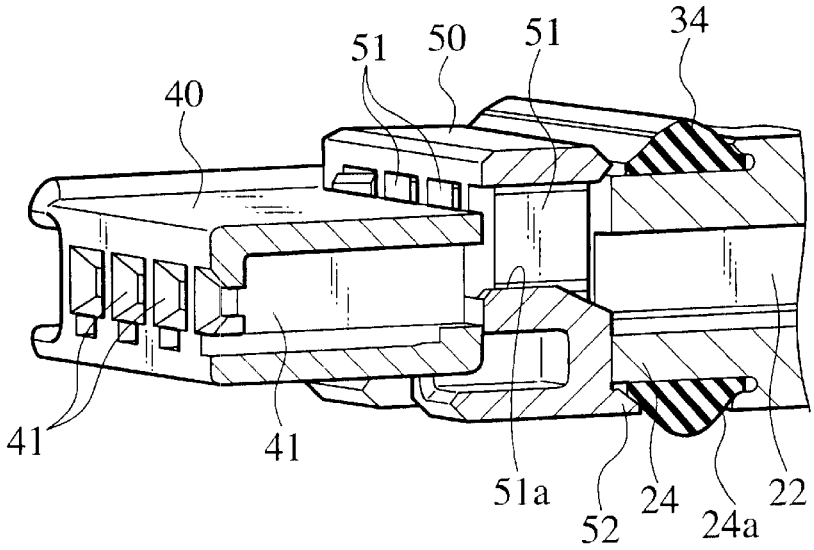
FIG. 2 is a cross sectional perspective view of a main portion of the waterproof connector according to the embodiment of the present invention, in which the slide is in a state of preventing the terminal from falling off.
Figure 4:
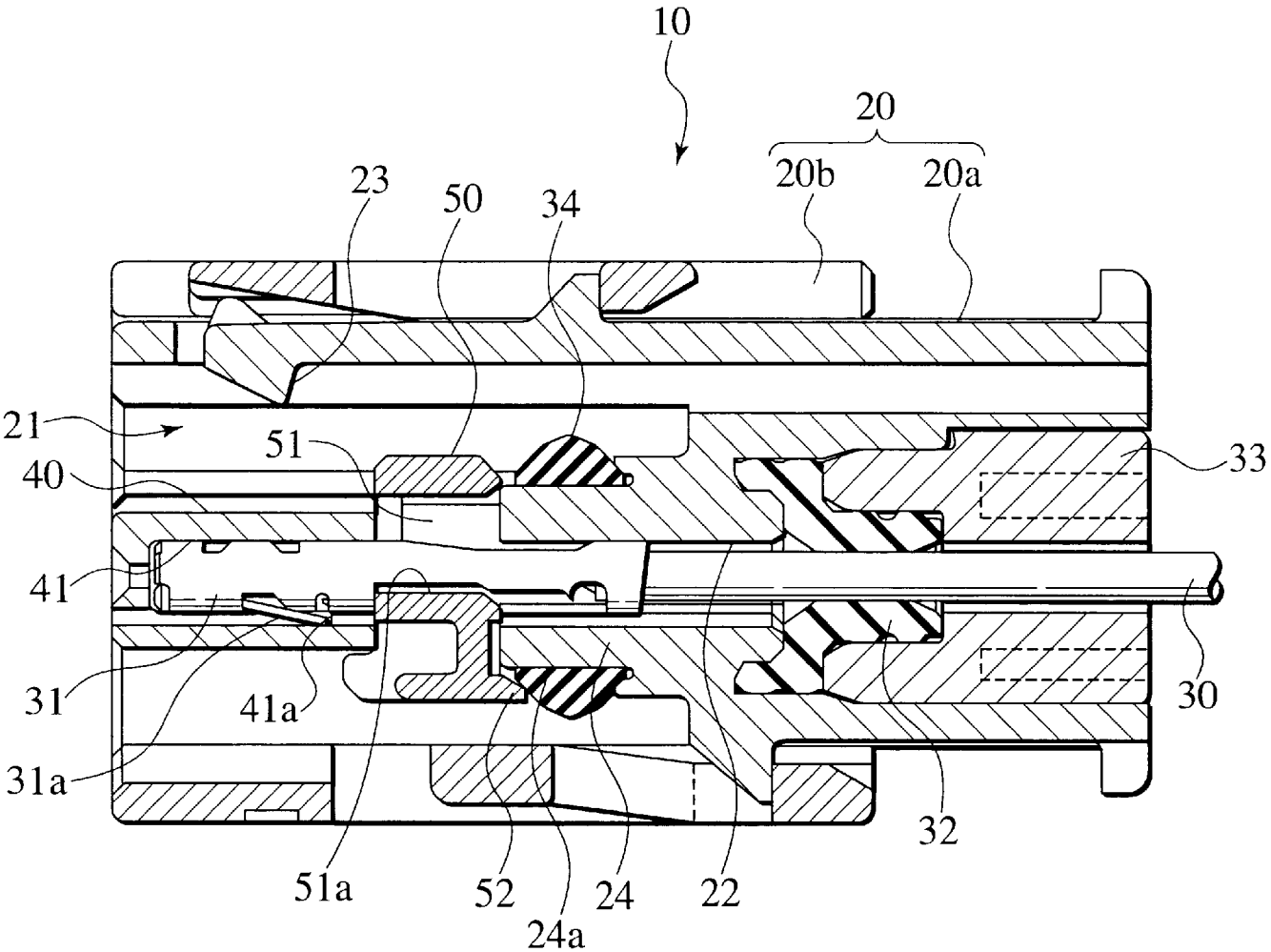
FIG. 4 is a cross sectional perspective view of the waterproof connector according to an embodiment of the present invention, in which the slide is in a state of preventing the terminal from falling off.

A waterproof connector 10 according to the present embodiment is provided with a connector housing 20 constituted by an inner housing 20*a* and an outer housing 20*b,* as shown in FIGS. 1 and 4, and a mating hollow 21 of an opposing connector (not shown) is open to a front end side (a left side in the drawing) of the connector housing 20. A plurality of guiding slots 22 to which a plurality of cables 30 are inserted are formed in a center portion of the connector housing 20 from a base end side (a right side in the drawing) toward a front end side, and cables 30 provided with terminals 31 are respectively passed through. A rear holder 33 is fitted to a base end portion of the connector housing 20 via a second packing 32 corresponding to a waterproof member closely fitted to the cables, whereby the cables 30 are fixed in a liquid tight manner.

The outer housing 20*b* is movably fitted to an outer side of the inner housing 20*a,* and the outer housing 20*b* moves to the front end side of the connector housing 20, thereby pressing down a hook 23 of the inner housing 20*a* so as to engage with the opposing connector. A tubular block 24 forming the guiding slots in a center portion and protruding within the mating hollow 21 is protruded from the inner housing 20*a,* and a first packing 34 having a semicircular cross sectional shape is fitted to a thinner portion 24*a* formed in an outer periphery of the tubular block 24.

The terminal 31 is structured such that one end portion is positioned within the tubular block 24, that is, within the guiding slots 22 of the tubular block 24 and another end portion is protruded from the tubular block 24 toward the front end side of the connector housing 20, and the protruded front end portion is received and held within a cavity 41 of a terminal housing 40. In the present embodiment, in view of a connection that a plurality of cables and corresponding terminals 31 are provided, the cavities 41 are provided so as to correspond to the number of the terminals 31.

Lances 31*a* inclined in a direction in which a base end side (a right side in the drawing) protrudes are provided in a portion in which the terminals 31 are received in the cavities 41, and the lances 31*a* are engaged with engaging abutments 41*a* within the cavities 41, whereby the terminals 31 are prevented from falling off. At this time, the terminal housing 40 received within the mating hollow 21 is structured such that a front end surface is arranged substantially on the same surface as the front end of the connector housing 20.

In this case, in the present embodiment, a slide 50 capable of switching between a temporarily engaging state allowing the terminal 31 to pass through and a formally engaging state engaging the terminal 31 in a come-off preventing direction and holding the packing 34 is provided between the terminal housing 40 and the packing 34, in detail, between the terminal housing 40 and the tubular block 24 fitting the packing 34.

The slide 50 is formed substantially along a cross sectional shape of the tubular block 24. In this slide 50 there are formed slits 51 to which the terminals 31 are inserted extending in a vertical direction to a longitudinal direction of the terminals 319 and having one side in the vertical direction constituting a temporarily engaging portion (refer to FIG. 3) and another side constituting a formally engaging position (refer to FIG. 4). That is, in the temporarily engaging position shown in FIG. 3, the slide 50 moves downward in the drawing, and the guiding slots 22 and the slits 51 become in the temporarily engaging state of linearly communicating with each other with no obstacle. Further, in the formerly engaging position shown in FIG. 4, the slide 50 is pressed upward in the drawing, and lower halves 51*a* of the slits 51 are inserted to extending portions of the guiding slots 22. Further, the inserted lower halves 51*a* are engaged with recesses 31*b* formed in the terminals 31 so as to become in the formerly engaging state of preventing the terminals 31 from falling off. At this time, a double engaging structure is formed by the tower half 51*a* of the slide 50 and the lance 31*a*.

Further, a retaining portion 52 capable of being brought into contact in the come-off preventing direction of the packing 34 is provided in an outer side in a side of the formerly engaging position of the slits 51, in the slide 50. That is, a lower end portion of the slide 50 is slightly extended in a base end side direction of the connector housing 20, where by the retaining portion 52 is structured, and retaining portion 52 presses an outer side in a front end side (a left side in the drawing) of the packing 34 at a time of switching the slide 50 from the temporarily engaging position to the formerly engaging position.

Figure 3:
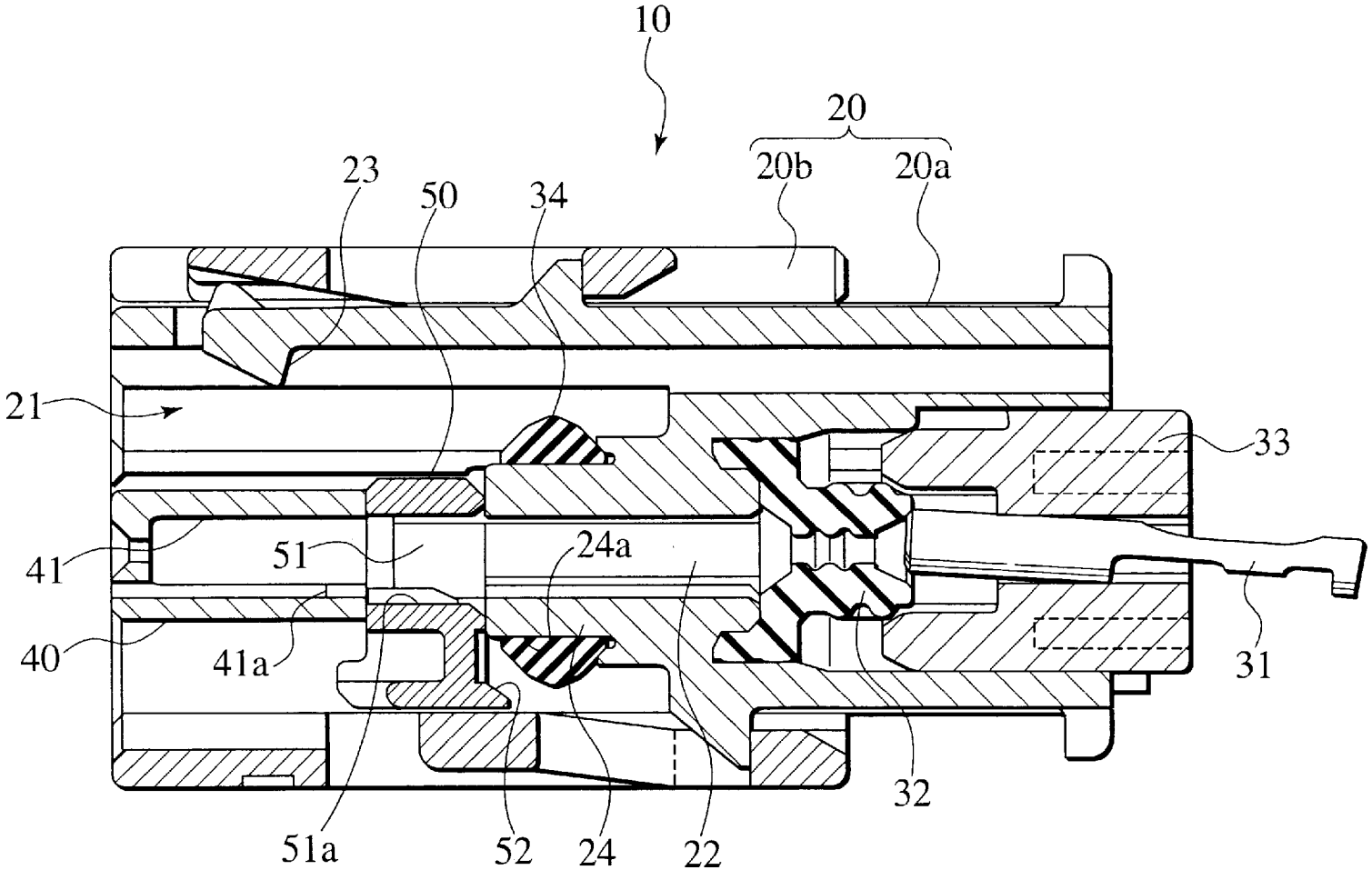

According to the structure mentioned above, in the waterproof connector 10 of the present embodiment, the terminals 31 connected to the cables 30 in the temporarily engaging state shown in FIG. 3 are inserted from the base end side of the connector housing 20 to a rear holder 33 and a second packing 32, and the terminals 31 are inserted from the guiding slots 22 to the slits 51 of the slide 50 so as to be inserted to the cavities 41 of the terminal housing 40. Then, the terminals 31 are received and held in the terminal housing 40 due to the engagement of the lances 31*a*. When switching the slide 50 from this temporarily engaging state to the formerly engaging position as shown in FIG. 4, the lower halves 51*a* of the slits 51 are engaged with the recesses 31*b* of the terminals 31, whereby the terminals 31 are prevented from falling off and become in the formerly engaging state of holding the packing 34. In this case, the formerly engaging position of the slide 50 is held by an engagement portion such as an uneven portion (not shown) or the like.

Accordingly, in the waterproof connector 10 according to the present embodiment, since the slide 50 is received within the connector housing 20, the slide 50 is not moved due to an external force. As mentioned above, at a time of transporting the waterproof connector 10, it is possible to protect by the connector housing 20 so that the slide 50 in the temporarily engaging state can not move to the formerly engaging state.

Further, since the switching operation between the temporarily engaging state and the formerly engaging state is achieved only by the slide 50, the structure becomes simple, and it is possible to easily apply to a downsized waterproof connector 10. Further, since the slide 50 is arranged between the terminal housing 40 and the packing 34 and is positioned in the inner side of the mating hollow 21 of the connector housing 20, it is possible to protect slide 50 by the connector housing 20 at a time of transporting the waterproof connector 10 or the like. Accordingly, even in the case that the inserted other connector 10 is brought into contact or the like, it is possible to prevent the external force from being applied to the slide 50, and it is possible to securely maintain the slide 50 in the formerly engaging state. Therefore, it is possible to prevent defective goods from being generated due to the reason that the terminals 31 come off from the terminal housing 40 and the terminal housing 40 drops off or the like.

Further, according to the present embodiment, the slide 50 can move in the vertical direction with respect to the longitudinal direction of the terminal 31 via the slits 51 on the basis of the simple structure that the slits 51 are formed in the slide 50, and it is possible to easily switch between the temporarily engaging state and the formerly engaging state due to the movement in the vertical direction. Further, it is possible to hold the packing 34 at the same time of switching the slide 50 to the formerly engaging state so as to execute the come-off prevention by the simple structure that the retaining portion 52 is formed in the outer side in the side of the formerly engaging position in the slide 51. Accordingly, the slide 50 can make the whole structure thereof simple.

Although the invention has been described above by reference to certain embodiments of the invention, the invention is not limited to the embodiments described above. Modifications and variations of the embodiments described above will occur to those skilled in the art, in light of the above teachings.

What is claimed is:

1. A waterproof connector comprising:

a connector housing comprising a mating hollow mating with an opposing connector and a terminal housing protruded within the mating hollow;

a first packing installed in the mating hollow at more inner recesses than the terminal housing so as to be pressed in close contact with the opposing connector; and a slide installed between the terminal housing and the first packing;

wherein the connector housing receives a plurality of cables each having a terminal at an end tip thereof so as to hold a second packing therebetween respectively; and the slide has, and can move between, two perpendicular positions, with respect to an insertion direction of the terminal, a first position allows the terminals to pass through the slide, and a second position prevents the terminals from falling off and holds the first packing.

2. A water proof connector according to claim 1, wherein:

the slide comprises a plurality of slits elongated in a direction in which the slide moves, each having the terminal to be inserted therein, and a retaining portion protruded from one end of the slide towards the first packing; and one side near the retaining portion of each slit prevents the terminal from fallen off and other side allows the terminal to pass therethrough.

* * * * *